US005553420A

United States Patent [19]

Klimek

[11] Patent Number: 5,553,420

[45] Date of Patent: Sep. 10, 1996

[54] CASEMENT WINDOW

[75] Inventor: David J. Klimek, Wausau, Wis.

[73] Assignee: SNE Enterprises, Inc., New York, N.Y.

[21] Appl. No.: 297,012

[22] Filed: Aug. 29, 1994

[51] Int. Cl.[6] ..... E06B 3/00

[52] U.S. Cl. ..... 49/501; 49/394

[58] Field of Search ..... 49/394, 501, 503, 49/346, 339, 341; 52/716, 204.51, 204.1, 204.53, 204.7, 204.705; 292/240, 241, DIG. 20, DIG. 47

[56] References Cited

U.S. PATENT DOCUMENTS

| | | | |
|---|---|---|---|
| 3,085,299 | 4/1963 | Reynaud | 49/394 X |
| 4,610,472 | 9/1986 | Billingsley | 292/DIG. 47 X |
| 4,803,808 | 2/1989 | Greisner | 49/394 |
| 4,807,914 | 2/1989 | Fleming et al. | 49/394 X |
| 4,837,977 | 6/1989 | Mauro . | |
| 4,982,530 | 1/1991 | Palmer | 49/501 X |
| 5,081,793 | 1/1992 | Mauro | 49/501 |

*Primary Examiner*—Jerry Redman
*Attorney, Agent, or Firm*—Gerald S. Geren

[57] ABSTRACT

There is disclosed herein a casement-style window assembly having a support frame which carries a pivotable sash assembly. The sash assembly has its own frame and carries a pane, usually transparent, therein. Both the frame and sash are constructed of multi-chambered extruded structural plastic members and interior decorative wood members that are arranged to conceal the plastic members from interior view. Weather stripping or insulation is fitted within various chambers. Operator and multi-point lock hardware are mounted to the structural plastic frame. Wooden stops associated with the sash frame cooperate to trap the pane in position and to engage the support frame when the window is closed. The sash frame structural member forms an L-shape which includes an affect member directed to the interior for engaging the support frame. In this construction the window assembly forms a functional unit even with the various wood members removed.

7 Claims, 4 Drawing Sheets

CASEMENT WINDOW

BACKGROUND OF THE INVENTION

This invention relates to window assemblies, where a sash is mounted in a support frame and the sash swings or pivots in the frame about an axis between open and closed positions; such windows are commonly referred to as casement or awning style windows.

A casement style window assembly is one which includes a support or peripheral frame for positioning in a building opening. A sash is also provided which includes a sash frame in which a pane (usually transparent) is mounted. The sash is carried or supported by the frame and is mounted thereto so as to swing about an axis. Usually the axis is adjacent one side of the support frame, so that the sash can swing or pivot outwardly about the axis between a closed position against the support frame and an open position away from the support frame.

A mechanical operator assembly is usually provided for the user to open and close the window assembly from inside the building. There is also provided a locking assembly for the user to lock the sash to the support frame when the window is closed. Moreover, a screen is mounted to the frame but on the inside so as to protect the interior and yet not interfere with the sash.

A patent that discloses window assemblies of this type is Mauro U.S. Pat. No. 4,837,977.

The window assembly may have a plastic or elastomeric exterior for exposure to the weather and a wooden interior for decorative purposes, but the window assembly must be structurally sound and functional. In the past this was accomplished by fabricating the entire window assembly (i.e. support frame and sash members) of wood. Then the exterior wood which would be exposed to the weather was clad with a weather resistant material such as aluminum, polyvinylchloride (PVC) or other elastomer. The belief is that these cladding materials will degrade less than wood when exposed to weather. The window interior assembly was still wooden for esthetic and decorative reasons.

The reduced availability and high cost of wood has increased the motivation to decrease the amount of wood used, to be sure there is wood for the interior decoration, and to maximize the use of structural plastic materials.

This has led to the increased use of extruded plastic materials such as PVC, which have multiple cavities or chambers and are sound structural members. The cavities and their related walls or webs, are intended to reduce weight without sacrificing strength.

Various structures have been suggested for utilizing the wood/extruded plastic combination.

However, it has been found to be desirable to provide a casement style window assembly where each pane carrying sash member includes a plastic exterior and wooden interior, where wooden stops cooperate with the plastic to retain the pane in position on the sash and the stops are essentially identical for each sash.

Thus, it is an object of this invention to provide a casement style window assembly, which employs a pivotable sash wherein the pane is held in position by a plastic structural member and a wooden stop that is essentially identical for each sash.

Present window frames using multi-chambered plastic elements may expose the plastic elements to the interior.

This exposure can create esthetic and even decorating problems.

Thus, it is another object of this invention to provide a casement style window construction, which minimizes plastic exposure to the interior but maximizes wood exposure.

When using a multi-chambered plastic extrusion, it is desirable to fill selected chambers with an insulating material that is provided in lineal form. But, it has been found that there can be problems when the weather stripping and the extrusion are cut to length for assembly. Particularly, where the extrusion is not the same length as the weather stripping but members are to be joined subsequently.

Therefore, another object of this invention is to provide a construction wherein the length of the plastic extrusion and weather stripping is the same or substantially the same.

It has been found to be desirable to secure various hardware, such as an operator assembly and/or a multi-point locking system to the frame and to minimize wood usage. Previously, substantial wood usage was needed in order to accommodate and mount such hardware.

Another object of this invention is to provide a casement structure which is suitable for mounting hardware to the frame and minimizes the use of wood.

These and other objects of this invention will become apparent from the following description and appended claims.

SUMMARY OF THE INVENTION

There is provided by this invention a casement style window that meets the foregoing objects.

The window assembly includes a support frame which carries a pivotable sash. Each sash includes its own frame that surrounds the edges of and retains a transparent pane. Both the support frame and sash are constructed of extruded multi-chambered structural plastic to which wood is affixed. The plastic is used for structural, strength and weather resistant reasons and the wood is used for decorative or esthetic reasons. Wooden stops are provided to engage the pane and cooperate is securing the pane to the sash frame. Other stops associated with the frame engage the sash in the closed position.

The casement window is constructed so that wooden members are secured to the plastic members, are exposed to the interior of the building and conceal the plastic from interior view. But, the plastic members are exposed to the exterior. In this way the wood required is minimized but appearance considerations are maximized. Moreover, this arrangement allows the flexibility to use various species of wood.

In the construction of this frame lineal weather stripping is applied to the frame extrusion and then the frame extrusion and lineal weather stripping are cut to length and fused or joined to form a corner.

All of the hardware, which includes the operator and the lock system can be applied to the frame, can be installed without application of the interior wood frame members and minimizes wood usage.

The sash also includes an offset leg positioned toward the interior which allows for the use of thicker insulated glass units without increasing wood usage. Interestingly, the offset leg even permits the reduction of wood usage in the event the pane is thicker. This offset can also act as a stop when the sash is closed.

DESCRIPTION OF THE PREFERRED EMBODIMENTS

Figure 1:
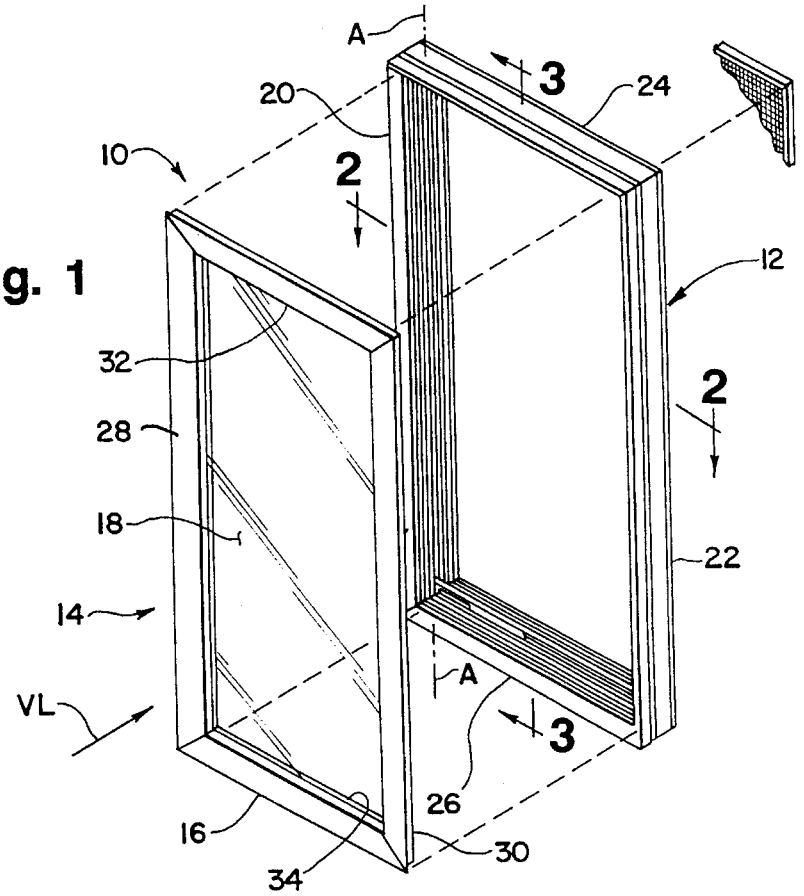
FIG. 1 shows in perspective view and in exploded style a casement window with the sash, frame, and screen, and the view is generally inwardly from the building exterior.
Figure 5:
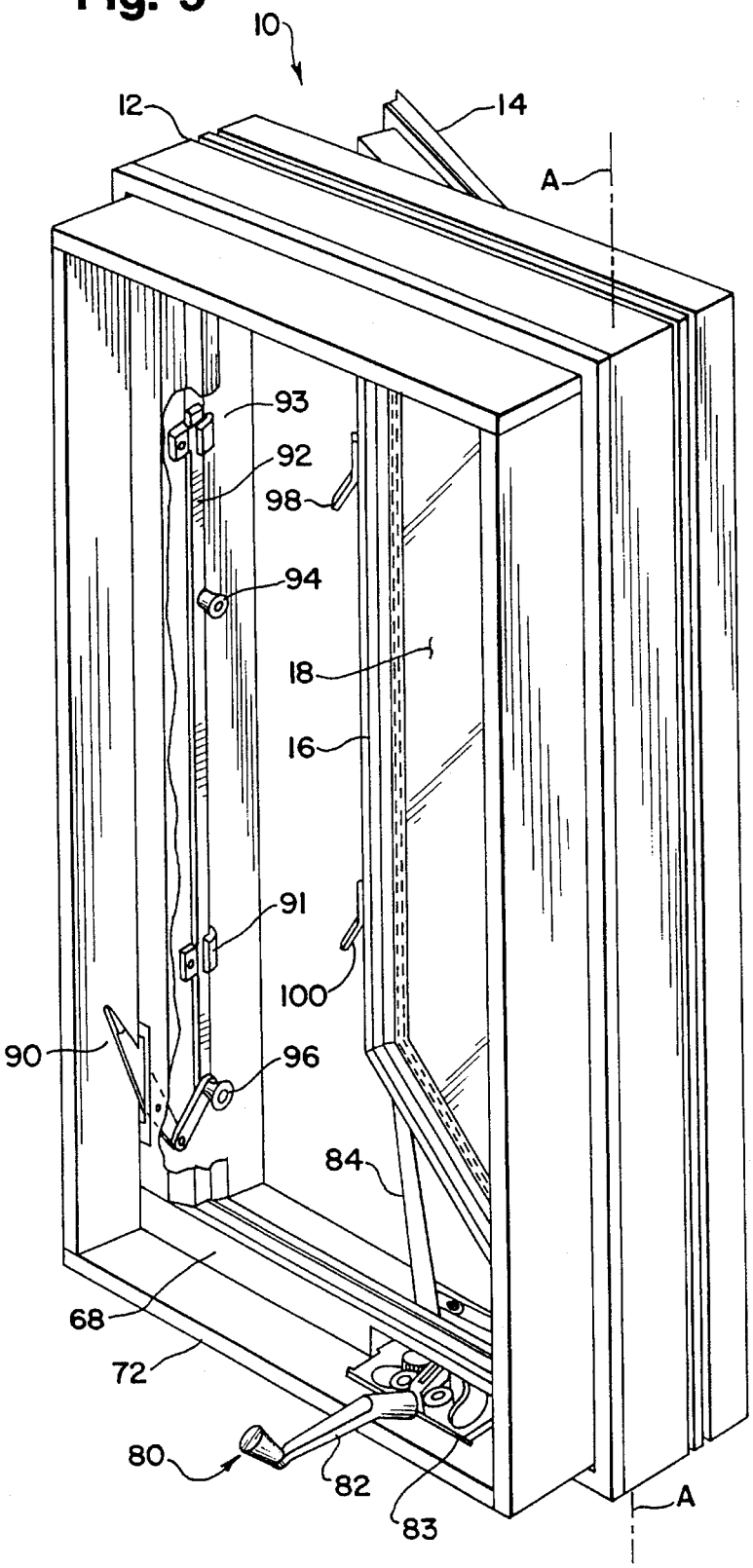
FIG. 5 is a perspective view of a casement type window showing operator and locking hardware and the view taken from the building inside.

Referring now to FIG. 1 and FIG. 5, there is shown a casement style window 10 generally which includes a main or support frame 12 for mounting in a building opening. A sash assembly 14 includes a sash frame 16 and a transparent pane 18 mounted in the sash frame 16. The sash is constructed to pivot about the axis A—A along one side of the frame.

Figure 2:
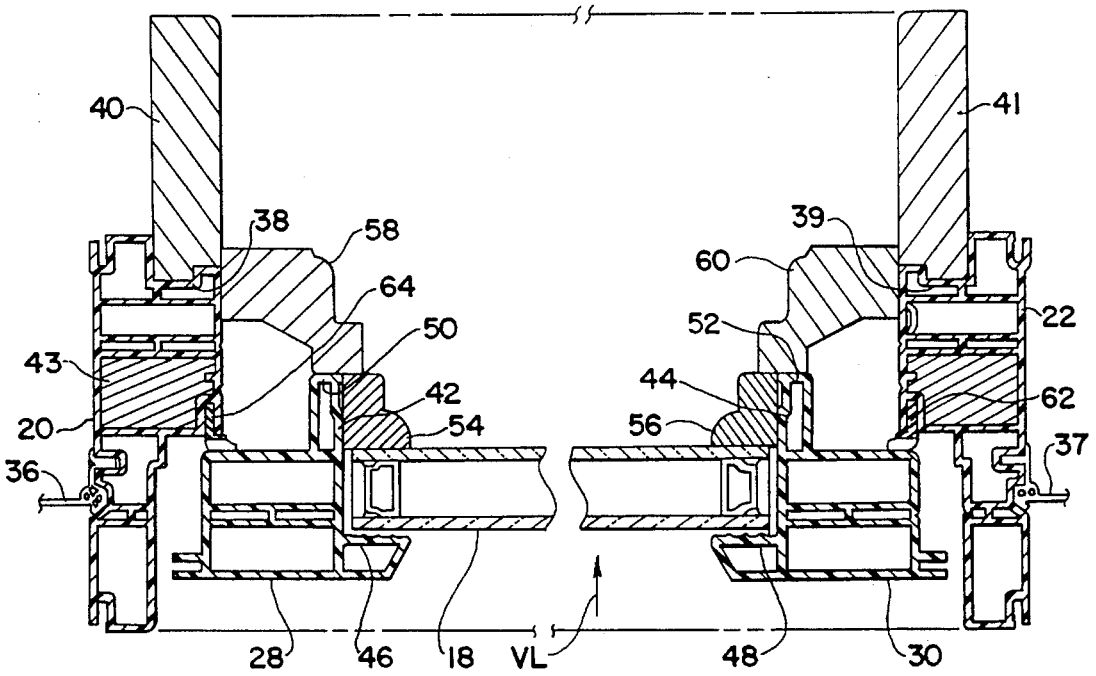
FIG. 2 is a horizontal sectional view taken essentially along 2—2 of FIG. 1 but with the sash closed against the frame, and the unit assembled.

Referring now to FIG. 2, the support frame 12 generally includes side members 20 and 22, top member 24 and bottom member 26. The sash frame 16 includes side members 28 and 30, top member 32 and bottom member 34. The view line VL is from the exterior of a building to the interior through the glass pane 18.

It is seen with reference to FIG. 2 that the side frame members 20 and 22 are multi-chambered polyvinylchloride extrusions. Nail fins 36 and 37 are provided to secure the frame 12 to a building opening. A pair of interior recess portions such as 38 and 39 are formed in the frame extrusion and grasp the edges of interior wood members 40 and 41 so as to hold those members in position. Lineal weather stripping such as 43 can be fitted into the chambers.

The sash frame includes the extruded plastic side members such as 28 and 30 which define a L-shaped interior surface which includes long legs such as 42 and 44 and short legs such as 46 and 48. The short legs 46 and 48 grasp and are secured to the peripheral side surface of a window pane 18. The long leg of the interior sash 42 cooperates in defining an offset portion such as 50 or 52. The pane edge engages the leg such as 42 and the pane is sealed to the sash frame extrusions by a silicone sealant. A wooden interior glass stop such as 54 or 56 is applied to the legs 42 and 44 and traps the pane 18 between it and the short legs 46 and 48. It is also seen that the offset portions such as 50 and 52 engage the interior frame members or stops 58 and 60 when the sash is closed. It will be appreciated that since this window is of the swinging type, the sash engages the peripheral frame such as at the seals 62 and 64. Here the sash can swing about an axis A—A and the sash can engage the seal such as 62 and 64 which also acts to stop the sashes movement toward the interior of the building and seal the sash. However, note that the sash extrusion 30 is basically engaging the frame extrusion 22.

Thus, in a sense the sash can close against the window and only the plastic structural members are necessary. The wooden members such as stops 54 and 56, members 58 and 60 and the interior members 40 and 41 are principally decorative rather than structural.

Figure 3:
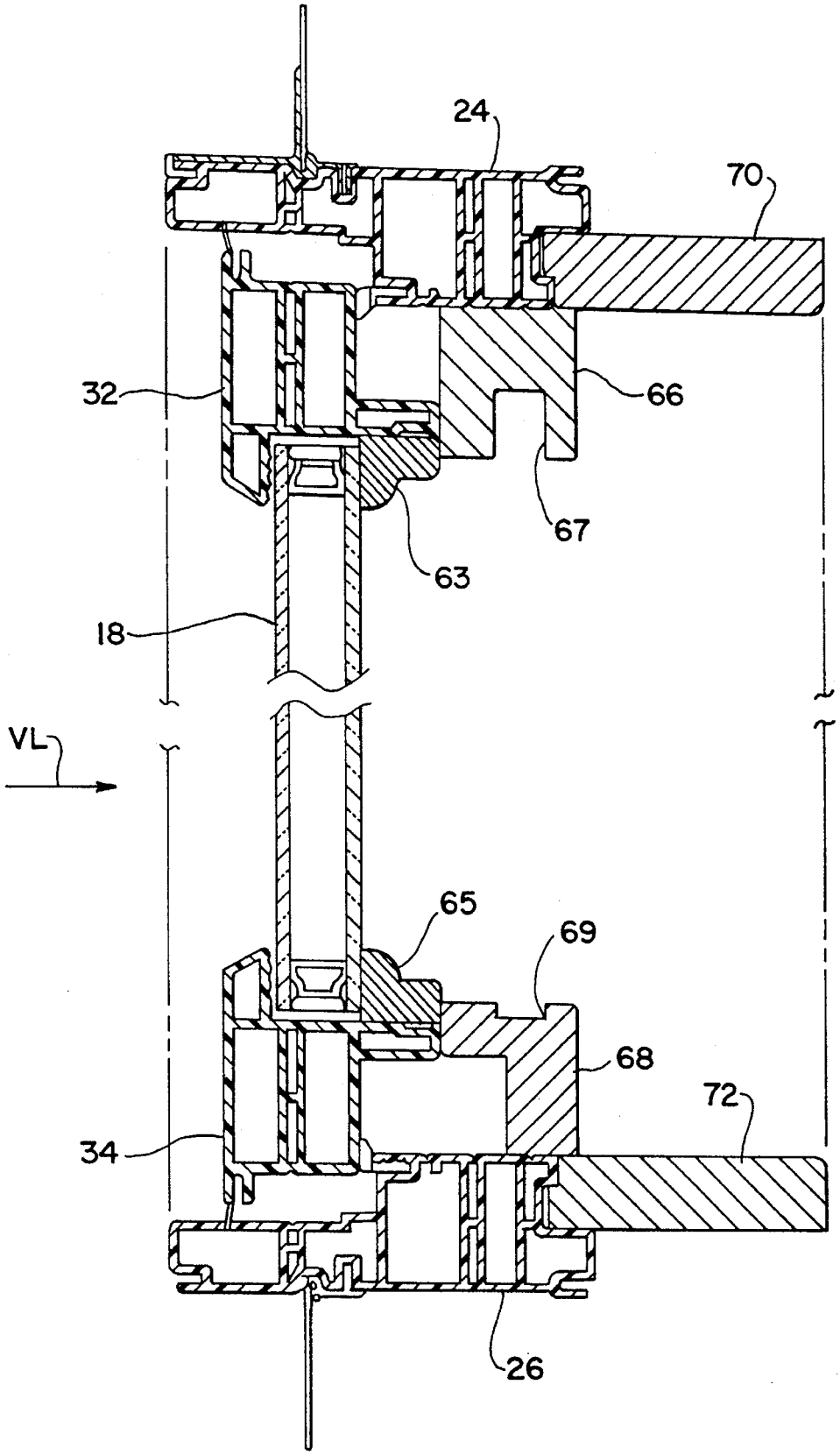
FIG. 3 is a vertical sectional view of the window of FIG. 1 but with the sash closed against the frame and the unit assembled.

Referring now to FIG. 3, a vertical section of the window is shown. It is seen that the top and bottom members 24 and 26 are basically identical, except for orientation, to the vertical or side members 20 and 22.

With respect to the sash, it is seen that the horizontal members 32 and 34 are the same basic shape as the vertical members 28 and 30. Horizontal wooden stops 63 and 65 are provided to cooperate with the pane and the sash to hold the sash in position. Interior wooden members 66 and 68 are provided and include grooves 67 and 69 for positioning and holding a screen. Interior wooden frame members 70 and 72 are also provided. It is seen that the member 72 forms an interior sill. Moreover, it is seen that all of the wooden members cooperate to conceal the plastic construction from interior view and thus provide the desired decorative appearance.

Figure 4:
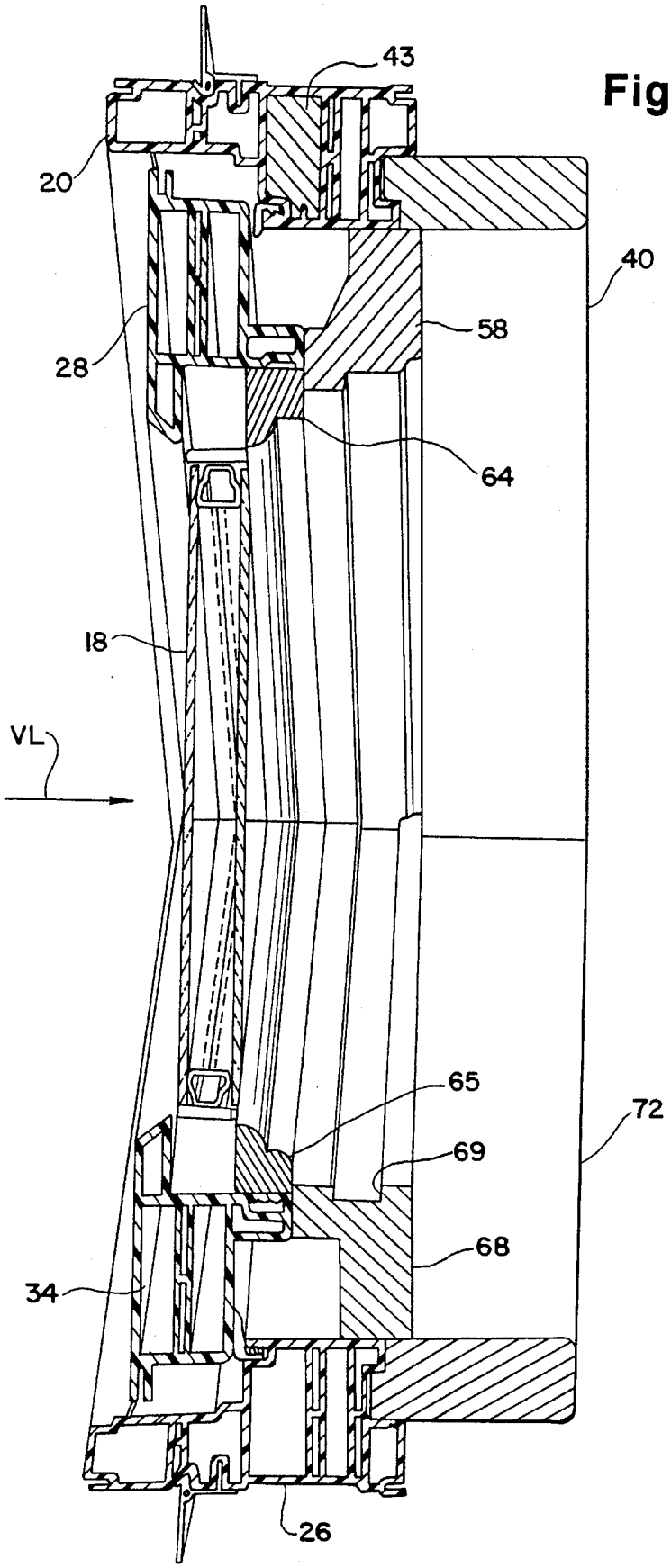
FIG. 4 is a perspective view of the lower left corner of a casement window.

Referring now to FIG. 4, a corner section of the window assembly is shown in which the vertical interior wooden member 41 is seen along with sill 72. The interior vertical member 58 is seen along with the interior bottom or horizontal member 68. It is to be noted that the interior bottom member 68 includes the groove 69, and the top member 66 (See in FIG. 3) includes the groove 67. The grooves, 67 and 69 cooperate to retain a screen. The vertical sash stop member and pane engaging member 54 is seen along with the horizontal sash stop and pane engaging member 65. The vertical plastic frame 20 with the weather stripping and lower plastic frame 26 is also seen along with the sash extrusion 28 and the bottom extrusion 32. From this view it can be seen that the plastic members 20 and 26 can be mitred to form the corner as well as the interior frame members 41 and 72.

Figure 6:
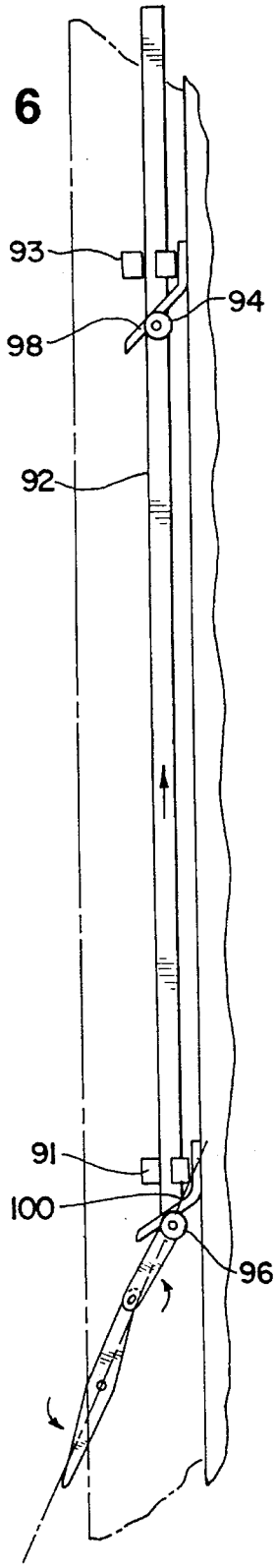
FIG. 6 is a elevational view of the locking hardware as shown in FIG. 5, but with the hardware in a locked position thereby locking the sash in position.

Referring now to FIGS. 5 and 6, the casement window is shown but from the inside. An operator 80 is provided whereby an inside handle 82 is rotated and operates a gearing system 83 associated with the handle which then in turns operates an elongated operator arm 84 that opens and closes the sash 14. Here it is seen that the operator is mounted within the bottom interior wooden member 68. However, the operator is mounted to the plastic frame member 26.

A multi-point locking system is also provided. That system includes a vertically movable and hinged over-the-center locking actuator handle 90 which can be moved between an up and down position so as to vertically move or slide the hingedly connected locking bar 92 upwardly and downwardly. The locking bar 92 carries two inwardly extending locking projections 94 and 96 which move upwardly or downwardly with the bar 92 in response to the movement of the handle 90. It is seen that the rod 92 is secured to the frame for sliding by brackets 91 and 93. The locking projections 94 and 96 cooperate with latches 98 and 100 carried on the free side edge of the sash. It is seen that when the sash is closed with the sash against the peripheral frame, the locking handle 90 can be moved downwardly which moves the bar 92 upwardly and thus the projections 96 and 94. The locking projections 96 and 94 thus engage the latches 100 and 98 as shown in FIG. 6. At this point, the over-the-center mechanism engages to lock the handle in its downward position. In this way a multiple point securement system is provided whereby the sash is held against the frame. The only members associated with the sash are the latches 98 and 100. Thus the locking point mechanism is for the most part associated with the peripheral frame.

It will be appreciated that numerous changes and modifications can be made to the embodiment disclosed herein without departing from the scope of this invention.

I claim as my invention:

1. A casement style window assembly having a peripheral frame adapted to be secured to a building at an opening and a pane-carrying sash pivotally connected to the peripheral frame, wherein the improvement comprises:

the peripheral frame constructed of a plurality of extruded multi-chambered structural plastic members arranged for exterior exposure and a plurality of decorative wooden members for securement to peripheral frame structural members and arranged for interior exposure;

the sash having a sash frame constructed of a plurality of extruded multi-chambered structural plastic members arranged for exterior exposure and of decorative wooden members for securement to the sash frame structural members and arranged for interior exposure;

the sash having a pane shaped to fit within and be retained by the sash frame;

a plurality of wooden stop members each member constructed to be secured to the sash frame and cooperate in retaining the pane within the sash;

the sash frame structural members forming pane retaining sections, each section having a first leg and a second leg which terminates in an inwardly extending section, the first leg constructed to retain a peripheral side surface of the pane; the second leg constructed to retain a peripheral edge of the pane and for mounting said wooden stop members; and the inwardly extending section and said wooden stop members constructed to engage at least one of said decorative members of the peripheral frame so as to provide a stop to movement of the sash toward the peripheral frame; and the pane being positioned between and retained by the first leg and the wooden stop members.

2. A window as in claim 1 wherein each pane retaining section is L-shaped and the first leg is a short leg of the L and the second leg is a long leg of the L.

3. A window as in claim 1 wherein the peripheral frame and the sash frame are each rectangularly shaped and corners of each are miter joined.

4. A window as in claim 1 wherein the decorative members cooperate in concealing structural members from interior view.

5. A window as in claim 1 which further includes an interior handle and an operator gear mechanism mounted to one of the peripheral structural frame members and operatively associated with the handle, and an arm operatively associated with the gear mechanism and the sash frame for use in moving the sash between open and closed positions.

6. A window as in claim 1 wherein there is further provided:

a multi-point locking system which includes:

a movable rod slidingly mounted to the peripheral frame adjacent a swingable edge of the sash, an actuator for moving the rod between locked and unlocked positions, a plurality of elongated locking projections mounted at one end to the rod and extending away therefrom, a plurality of locking latches mounted to the sash in locking alignment with the projections and for engagement by the projections, so that movement of the rod to the locking position when the sash is closed causes the locking projections to engage the latches and movement from the locking position causes disengagement.

7. A casement style window assembly having a peripheral frame adapted to be secured to a building at an opening and a pane-carrying sash pivotally connected to the peripheral frame, wherein the improvement comprises:

the peripheral frame constructed of a plurality of extruded multi-chambered structural plastic members arranged for exterior exposure and a plurality of decorative wooden members for securement to the peripheral frame structural members for interior exposure and arranged for interior exposure;

the sash having a sash frame constructed of a plurality of extruded multi-chambered structural plastic members arranged for exterior exposure and of decorative wooden members for securement to the sash frame structural members and arranged for interior exposure;

the sash having a pane shaped to fit within and be retained by the sash frame;

a plurality of wooden stop members each member constructed to be secured to the sash frame and cooperate in retaining the pane within the sash;

the sash frame structural members forming pane retaining sections, each section having a first-leg and a second-leg which terminates in an inwardly extending section, the first leg constructed to retain a peripheral side surface of the pane; the second leg constructed to retain a peripheral edge of the pane and for mounting the wooden stop members; and the inwardly extending section and the wooden stop members constructed to engage decorative members of the peripheral frame so as to provide a stop to movement of the sash toward the peripheral frame;

the pane being positioned between and retained by the first leg and the wooden stop member;

wherein each pane retaining section is L-shaped and the first leg is a short leg of the L and the second leg is a long leg of the L;

wherein the peripheral frame and sash frame are each rectangularly shaped and corners are each miter joined;

wherein the decorative members cooperate in concealing structural members from interior view;

which further includes an interior handle and an operator gear mechanism mounted to one of the structural peripheral frame members and operatively associated with the handle, and an arm operatively associated with the gear mechanism and the sash for use in moving the sash between open and closed positions; and wherein there is further provided:

a multi-point locking system which includes:

a movable rod slidingly mounted to the peripheral frame adjacent a swingable edge of the sash, an actuator for moving the rod between locked and unlocked positions, a plurality of elongated locking projections mounted at one end to the rod and extending away therefrom, a plurality of locking latches mounted to the sash in locking alignment with the projections and for engagement by the projections, so that movement of the rod to the locking position when the sash is closed causes the locking projections to engage the latches and movement from the locking position causes disengagement.

* * * * *